United States Patent [19]

Duff

[11] Patent Number: 4,697,754

[45] Date of Patent: Oct. 6, 1987

[54] TOILET ROLL HOLDER AND DISPENSER

[75] Inventor: Kenneth S. Duff, Blenheim, New Zealand

[73] Assignee: Durolla Products (N.Z.) Limited, Auckland, New Zealand

[21] Appl. No.: 728,529

[22] Filed: Apr. 29, 1985

[30] Foreign Application Priority Data

Apr. 27, 1984 [NZ] New Zealand ..... 207976

[51] Int. Cl.[4] ..... B65H 19/04

[52] U.S. Cl. ..... 242/55.3; 242/55.53; 221/301

[58] Field of Search ..... 221/301, 107; 242/55.3, 242/55.53, 55.2; 312/39

[56] References Cited

U.S. PATENT DOCUMENTS 3,580,651 5/1971 Gauper ..... 312/39
3,753,507 8/1973 James et al. ..... 214/16.4 R
3,865,295 2/1975 Okamura ..... 225/47
4,389,026 6/1983 Willa et al. ..... 242/55.3

FOREIGN PATENT DOCUMENTS 1907716 11/1969 Fed. Rep. of Germany ..... 242/55.3
2108927 5/1983 United Kingdom ..... 242/55.3

*Primary Examiner*—Joseph J. Rolla
*Assistant Examiner*—Michael S. Huppert
*Attorney, Agent, or Firm*—Holman & Stern

[57] ABSTRACT

A roll holder for holding a stack of toilet rolls for sequential access by a user. The chamber for holding the rolls includes a pivotal member which holds the stack separate from the roll from which paper is being dispensed.

In one embodiment of the invention access to the actuator for the pivotal member is blocked until the roll from which paper is being dispensed has finished and is removed.

4 Claims, 13 Drawing Figures

TOILET ROLL HOLDER AND DISPENSER

Figure 1:
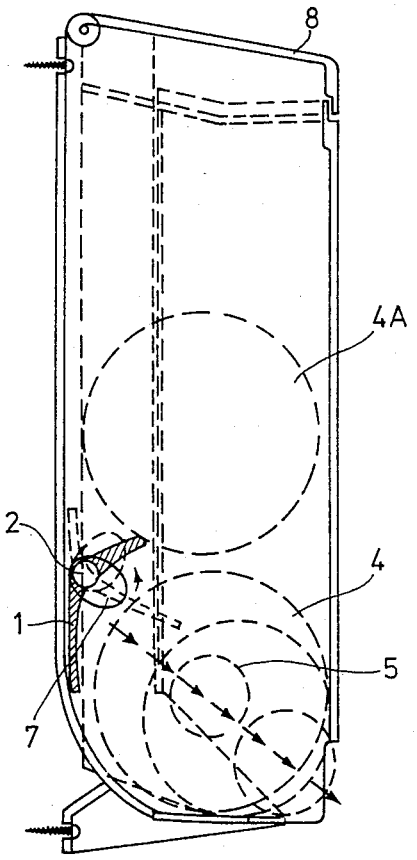

The present invention relates to improvements in and/or relating to roll holders and in particular roll holders suitable for dispensing toilet paper.

In New Zealand patent specification Nos. 188643/190471 and 196968 there is disclosed the concept of a container capable of receiving a plurality of toilet rolls with the axes of the toilet rolls substantially parallel and horizontal, (but horizontally spaced) and which allows the unwinding of the lower most roll. To facilitate such unwinding an impeding means is provided just above the position which the lower most roll will assume when being used for dispensing purposes. Such impeding means as disclosed in the abovementioned patent specifications are not completely satisfactory, and accordingly it is an object of the present invention to provide apparatus which will have some improvement thereover.

Accordingly in one aspect the present invention may broadly be said to consist in a roll holder comprising a container for a roll of webbed material, said container being essentially an elongated box like formation having two ends, a loading aperture at or adjacent one end through which a plurality of rolls can be successively inserted into the interior of the container, the other end being formed to support the lower most roll when the container is oriented to have its longitudinal axis substantially vertical, and at or adjacent said other end a withdrawal apperture to enable a web of material to withdrawn from said lower most roll (the "dispensing roll")

and impeding means to impede the passage of each roll through the container towards said other end, said impeding means being a member capable of being pivoted substantially about a pivot axis substantially parallel to the axis of toilet rolls receivable within said container, said impeding means being pivotal and so arranged so when a lower most roll is in a dispensing condition the member is pivoted to impede downward progress of the next roll, but when the lower most roll has been finished it will upon its pivotable and such other movement, if any, as is appropriate, allow the replacement of that lower most roll with the lower most roll of a stack impeded by said impeding means.

Preferably there is provided manual means to allow the manipulation of said impeding means after depletion of the dispensing roll so as to allow the lower most roll of the stack impeded by said impeding means to assume the dispensing roll condition.

Preferably said manually actuable means are or is disposed substantially wholly within the interior of the container and manual operation thereof is through the withdrawal apperture.

Preferably said manually actuable means moves reproducibly along a sliding axis with means being provided to abut the impeding means to cause, by the provision of the abutment, the pivoting of the impeding means and then allow the subsequent return of the impeding means, when the abutment has been removed.

In another aspect the present invention consists in a dispenser for cylindrical rolls of sheet material, which dispenser comprises a dispenser for cylindrical rolls of sheet material, which dispenser comprises a body or body assembly having a front wall, a rear wall, side walls and first and second end walls, an inlet for inserting rolls into the body located in or adjacent to the first end of the body or body assembly an opening of length at least equal to the width of said sheet material of said roll, said aperture located in or adjacent to said second end of the body or body assembly through which the sheet material can be withdrawn and a pivoted impeding means located so that its pivot axis is substantially at least but less than two roll diameters from said second end of the body, said pivoted impeding means having its pivot axis parallel to the axes of rolls loaded or to be loaded within said body or body assembly and arranged so that when there is a roll presented to said opening the next roll therefrom within said body or body assembly is spaced therefrom by the action of said impeding means but can be brought into that position upon the pivoting of said impeding means when the first roll has been finished and removed from said body or body assembly.

In a another form of the present invention preferably manual means is provided to allow the manipulation of said impeding means to allow the positioning of the lower most roll of a stack rolls previously impeded by the impeding means into the dispensing position.

Preferably the dispenser is substantially as hereinbefore described with reference to any of the accompanying drawings.

Preferably the roll holder is substantially as hereinbefore described with reference to any of the accompanying drawings.

In a further aspect the present invention consists in a roll holder or dispenser, as the case may be, in accordance with the present invention wherein said container, body or body assembly, as the case may be, is formed as a structure substantially as hereinafter described with reference to any one or any grouping of the figures of the accompanying drawings.

In another aspect the present invention may broadly be said to consist in a toilet roll dispenser including a pivoted impeding means.

Figure 4:
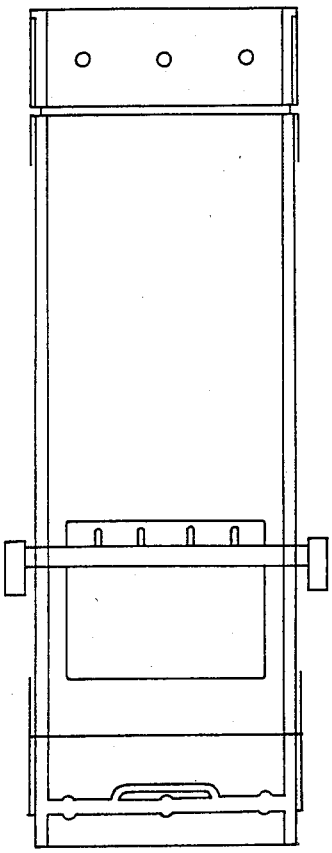
Figure 5:
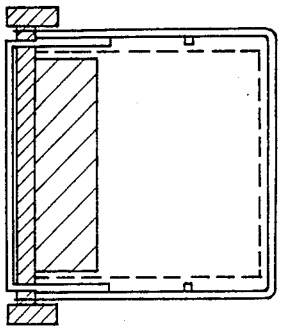
Figure 2:
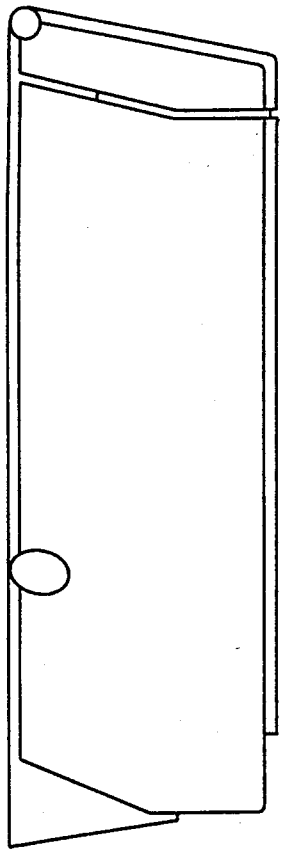
Figure 3:
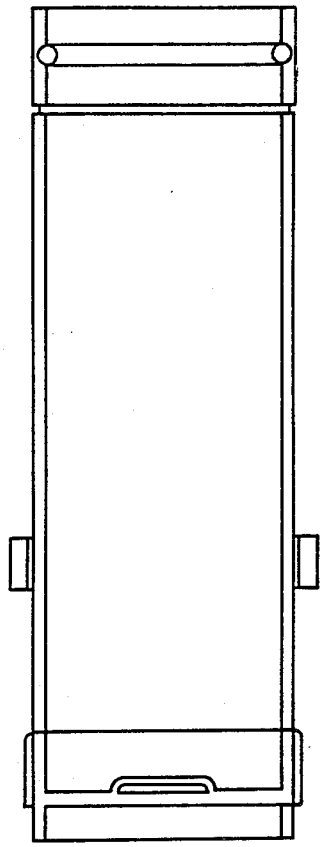
Figure 6:
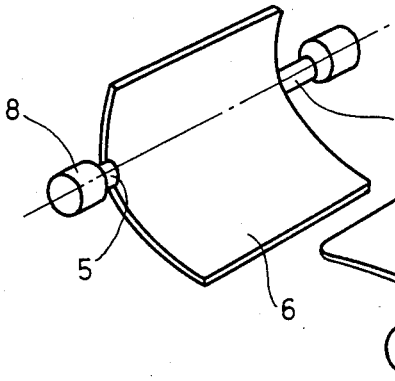
Figure 7:
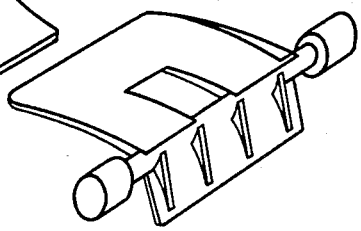
Figure 8A:
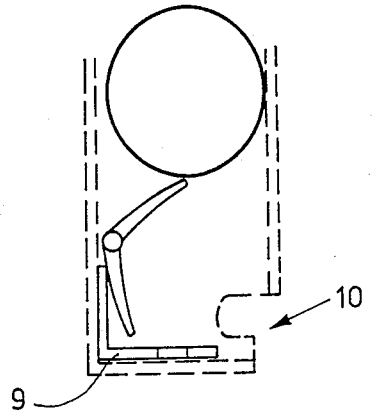
Figure 8B:
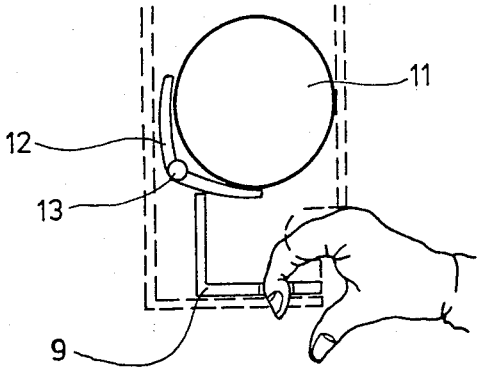
Figure 8C:
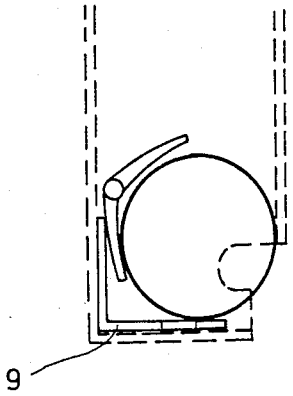
Figure 9:
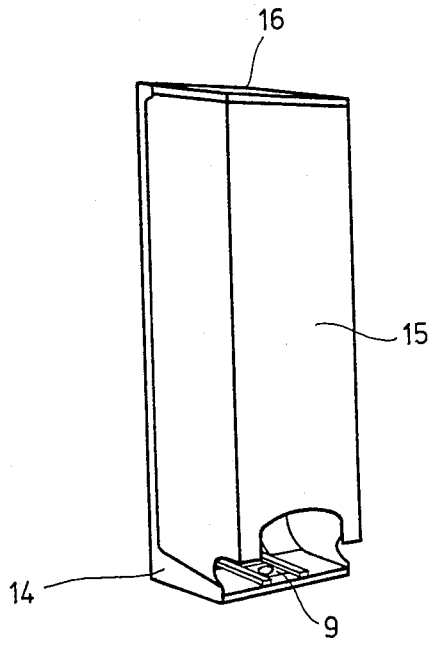
Figure 10:
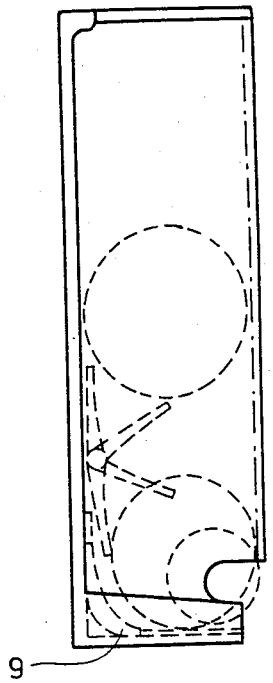
Figure 11:
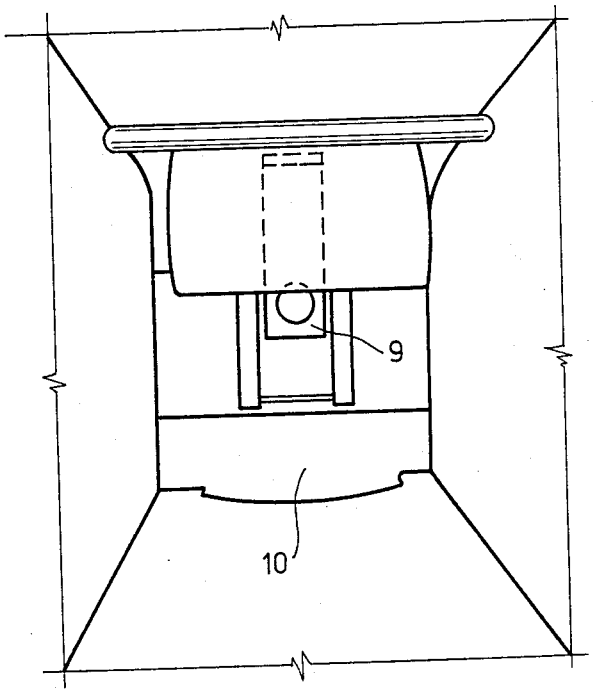

Preferred forms of the present invention will now be described with reference to the accompanying drawings in which FIG. 1 is a diagrammatic sectional view of apparatus in accordance with the present invention showing two toilet rolls disposed within the container or body assembly, the lower most roll being presented to a dispensing opening while the next roll is spaced therefrom by the pivoted impeding means which assumes the position shown in cross hatching, but which can upon completion of the lower most roll pivot to the dotted position to allow the receiving thereonto of the next roll and the pivoting thereof therepast, FIG. 2 is a similar view to that of FIG. 1 but showing the nature of the loose opening on either side of the body which receives the impeding member and pivotally mounts the same, FIG. 3 is a front elevational view of the apparatus FIG. 4 is a similar view to that of FIG. 3, but showing the body member in section so as to show the nature of the impeding means, FIG. 5 is a plan view of apparatus in accordance with the present invention showing in dotted outline a toilet roll, but not showing the top of the container, FIG. 6 is a view from above of the preferred impeding means in accordance with the present invnetion showing the rocker-like pivotal mounts of the same, FIG. 7 is a reverse side view of the impeding means in accordance with FIG. 6, FIGS. 8A to 8C show diagrammatically an embodiment of the present invention where after a dispensing roll has been completed and removed manually actuable means can be utilised in the manner shown through FIGS. 8A to 8C so as to move the pivotal impeding means to allow the lowermost roll of an impeded stack to assume the dispensing roll condition, FIG. 9 is a perspective view of an embodiment in accordance with the present invention showing a form of the invention embodying a sliding manually actuable element as depicted diagrammatically in FIGS. 8A to 8C, FIG. 9 showing no roll in a dispensing condition, FIG. 10 is a side elevation view showing in dotted outline the range of movements of the impeding means relative to the body and, FIG. 11 is a top view down through the top of the container, body member etc showing the pivotal member from above, trunnions or other members positioned into holes, or preferably receiving depressions in the the wall, and showing from above a portion of the member slidably movable and arranged to enable the manual actuation of the impeding means.

In the preferred form of the present invention the body assembly is formed from a series of body mouldings. As can be seen however, a member 1 pivoted about a pivot axis 2 is provided at least one but less than two roll diameters from the bottom of the dispensing opening 3 from which a lower most roll 4 can have the webbing thereof withdrawn and through which the core 5 of such a roll can be withdrawn when the web material has been completely removed.

The impeding means shown in FIGS. 6 and 7 preferably has portions thereof 5 about which the shaped member 6 can rock within the openings 7 shown in the side walls of the body.

Preferably the arrangement incudes a cover member 8, which can if desired, be lockable.

In use therefore a stack of rolls 4, 4A etc., would be inserted down into the container or body member and would be held up by the member 1 when in the condition shown in cross hatching in FIG. 1. This would allow any already positioned roll 4 to be utilised and to rotate freely without impedance from stacked rolls thereabove. When such a lower most roll however has been finished the member 1 can pivot, for example, under the action of fingers acting on member 8 or otherwise between the two conditions shown in FIG. 1 so that roll 4A can assume the position of roll 4 shown in FIG. 1 and roll 4B (not shown) assumes the position previoulsy assumed by roll 4A. For this to be achieved it is desirable that the arrangement be such taht pivoting of the member is required to allow the passage of a roll. The lowering of one roll brings the impedance into a condition as shown in FIG. 1 which prevents the next roll from passing the same.

In the form of the present invention as depicted in FIGS. 8 through to 11, irrespective of any inherent instability in the pivotal condition of the impeding means, a slidable member 9 is provided which can be engaged by a finger of a person through the dispensing opening 10 when a dispensing roll has been completed so that when pulled from a condition as shown in FIGS. 8A, 10 and 11 to a condition as shown in FIG. 8B, the next roll 11, which is to assume the dispensing roll condition as shown in FIG. 8C, moves past the impeding means 12 which is then allowed to pivot from the condition as shown in FIG. 8B about it pivot trunnions or the like 13 to allow the dropping of the roll into the dispensing roll condition as shown in FIG. 8C when the member 9 has been returned to its original condition. A person skilled in the art will appreciate how such a manually operable means is best wholly confined within the container for aesthetic reasons and also to avoid unwarranted interference when there is already a dispensing roll in its dispensing condition.

As far as the form of container is concerned as shown in FIG. 9 preferably the same as formed in a number of molded parts. For example part 14 could be moulded such that the remaining 3 side walls of the container can be clip fitted thereto and/or possibly adhesively engaged therewith. Such a separate molding 15 would preferably include portions adapted to anchor the ends 13 of the impeding means 12. Fabrication would thus be made easy with it only then being necessary to provide the member 9 within its guides and provide the pivotal top member 16 which preferably engages up under a top limit of the member 14 to be held in pivotal association therewith after engagement of the member 15 with the member 14. A person skilled in the art will appreciate how moldings are kept to their simplest configurations with such an arrangement.

It is believed that apparatus in accordance with the present invention comprises a worthwhile advance in the toilet roll and other webb material dispensing art.

What is claimed is:

1. A roll holder comprising a container for rolls of web material, the container being in the form an elongated box-like formation having two ends, a loading aperture at one end through which a plurality of rolls can be successively inserted into the interior of the container, the other end being formed to support a lowermost one of the rolls when the container is oriented to have its longitudinal axis substantially vertical, and a withdrawal aperture adjacent the other end of the container to enable a web of material to be withdrawn from the lowermost roll, the container including internal impeding means for impeding the passage of successive rolls through the container towards said other end, the impeding means comprising a pivot member mounted for pivoting about a pivot axis substantially parallel to respective axes of the rolls received within the container, the impeding means being so arranged that when the lowermost roll is in a dispensing condition, the pivot member is pivoted to impede downward progress of a succceeding roll, but when the lower most roll has been finished, the impeding means will upon its pivotal movement allow the succeeding roll to move into dispensing position in place of the lowermost roll, and wherein there is provided manually actuable means for manipulating the impeding means after depletion of the lowermost roll so as to allow the succeeding roll to assume the dispensing position, the manually actuable means being disposed wholly within the interior of the container for manual operation thereof by insertion of a user's finger through the withdrawl aperture only when the lowermost roll has been finished and removed.

2. A roll holder as claimed in claim 1, wherein the pivot member comprises a bell crank lever having upper and lower arms, and the manually actuable means comprises an L-shaped actuator having a horizontal limb located in a base portion of the container below the withdrawal aperture and a vertical limb engaging the lower arm of the bell crank lever, the actuator being movable horizontally to pivot the bell crank lever.

3. A dispenser for cylindrical rolls of sheet material comprising a body having a front wall, a rear wall, side walls and first and second end walls, an inlet for inserting rolls into the body at a first end of the body, an aperture of a length at least equal to the width of the sheet material, the aperture being located adjacent a second end of the body for withdrawal of sheet material, a pivoted impeding means located within the body with a pivot axis less than two roll diameters from said second end of the body, the impeding means having its pivot axis parallel to axes of rolls loaded within the body and arranged so that when there is a roll presented to said aperture, the next roll therefrom within the body is held spaced therefrom by the action of the impeding means but can be brought into dispensing position upon pivoting movement of the impeding means only when said roll presented to the opening has been finished and removed from the body, and manual means located wholly within the body for manipulating the impeding means to allow the positioning of said next roll by the impeding means into dispensing position by access to the manual means by insertion of a user's finger into the body through said aperture.

4. A dispenser a defined in claim 1 wherein the impeding means comprises a bell crank lever having upper and lower arms and the manual means comprises a L-shaped actuator having a horizontal limb located in a base portion of the body below said aperture and a vertical limb engaging the lower arm of the bell crank lever, the actuator being movable horizontally to manipulate the bell crank lever.

* * * * *